United States Patent [19]

Foss et al.

[11] Patent Number: 4,735,887

[45] Date of Patent: Apr. 5, 1988

[54] WASH-OFF FILM CONTAINING SYNTHETIC AMPHOTERIC POLYMERS

[75] Inventors: Robert P. Foss, Hockessin; Daniel R. Fruge, Wilmington, both of Del.

[73] Assignee: E. I. Du Pont de Nemours and Company, Wilmington, Del.

[21] Appl. No.: 879,400

[22] Filed: Jun. 27, 1986

Related U.S. Application Data

[63] Continuation-in-part of Ser. No. 726,693, Apr. 22, 1985, abandoned.

[51] Int. Cl.[4] ..... G03C 1/06

[52] U.S. Cl. ..... 430/264; 430/265; 430/266; 430/267; 430/268; 430/569; 430/630; 430/545; 430/627; 430/628; 430/941

[58] Field of Search ..... 430/204, 205, 264, 265, 430/266, 267, 268, 569, 630, 545, 627, 628, 941

[56] References Cited

U.S. PATENT DOCUMENTS

| | | | |
|---|---|---|---|
| 377,373 | 8/1877 | Foss . | |
| 3,681,079 | 8/1972 | Fitzgerald | 96/114 |
| 3,692,753 | 9/1972 | Smith et al. | 260/79.7 |
| 3,749,577 | 7/1973 | Hollister et al. | 96/114 |
| 3,813,251 | 5/1974 | Hollister et al. | 96/114 |
| 3,907,572 | 9/1975 | Ueda et al. | 96/100 |
| 3,957,492 | 5/1976 | Miyazako et al. | 96/114 |

FOREIGN PATENT DOCUMENTS

| | | |
|---|---|---|
| 889760 | 2/1962 | United Kingdom . |

*Primary Examiner*—Paul R. Michl
*Assistant Examiner*—Patrick A. Doody

[57] ABSTRACT

Sharper edges are obtained in silver halide wash-off films for tanning development when from 5 to 60% of the unhardened gelatin binder in one or more layers is replaced with a synthetic amphoteric polymer consisting essentially of at least one of each of three constituents: (a) carboxylic acid, (b) alkyl primary amine, and (c) secondary and/or tertiary amine, the amphoteric polymer having an isoelectric point of from 4 to 8.

26 Claims, No Drawings

WASH-OFF FILM CONTAINING SYNTHETIC AMPHOTERIC POLYMERS

CROSS REFERENCE TO RELATED APPLICATIONS

This application is a continuation-in-part of application Ser. No. 726,693, filed Apr. 22, 1985 now abandoned.

FIELD OF THE INVENTION

This invention relates to silver halide wash-off films. More particularly this invention relates to silver halide wash-off films containing synthetic amphoteric polymers.

BACKGROUND INFORMATION

The use of synthetic amphoteric polymers in photographic silver halide emulsions is known. Hollister et al. U.S. Pat. No. 3,749,577 discloses a photographic silver halide emulsion containing polymers prepared by direct polymerization of monomers having a carboxyl functionality, e.g., acrylic acid, and monomers having a quaternary ammonium functionality. Hollister et al. U.S. Pat. No. 3,813,251 discloses such a use for similar polymers having a tertiary ammonium functionality.

Smith et al U.S. Pat. No. 3,692,753 discloses a silver halide emulsion containing amphoteric polymers of, e.g., N,N-dimethyl- and N,N-diethylaminoethyl methacrylate, acrylic acid, and acrylamides or acrylates having thioalkyl groups in the alkyl chain.

U.K. Patent Specification No. 889,760 discloses light-sensitive emulsions to which are added synthetic amphoteric polymers prepared by hydrolysis of polymers containing groups capable of producing acidic and basic groups on hydrolysis.

Assignee's Foss patent application Ser. No. 377,373, filed May 12, 1982, discloses specified synthetic amphoteric polymers which can be added during the precipitation of silver halide emulsions and serve as a partial or complete replacement for gelatin.

In the above United States patents the presence of a synthetic amphoteric polymer acts as a peptizing agent in the precipitation and ripening step during the preparation of a photographic silver halide emulsion. In the United Kingdom patent the additon of amphoteric polymers during silver halide emulsion preparation is said to improve the emulsion, e.g., high silver concentration and the silver halide from such emulsions can be rapidly washed and finally redispersed. Assignees' Foss application Ser. No. 377,373, filed May 12, 1983 discloses the preparation of specified synthetic amphoteric polymers which can serve as a partial or complete replacement for the gelatin binder of a silver halide emulsion.

Although the aforementioned patents and application seek to improve either film variability due to the physical and chemical variabilities found in gelatin or one or more of various physical properties such as film toughness, they do not consider the particular problem of image sharpness in wash-off films. The preparation of wash-off films is known from disclosures such as U.S. Pat. Nos. 3,353,958; 3,364,024; 3,440,049; 3,453,111; 3,615,529; 3,856,524; 4,076,531; 4,233,392; 4,427,757 and 4,456,676, the disclosures of which are incorporated by reference. In common, these reference disclose the use of unhardened gelatin as the binder for wash-off films in which tanning development takes place to harden the gelatin in proximity with developing silver. Unhardened gelatin is then washed away to produce the wash-off image. Apparently due to the gelling characteristics of the gelatin binder as well as diffusion of oxidized developer responsible for the hardening action outside of the areas of developing silver, the sidewalls of the resulting relief image is often jagged which results in loss of image resolution.

It is desirable to provide a wash-off film for tanning development having one or more unhardened gelatin layers, including an unhardened silver halide emulsion layer, wherein a portion of the gelatin is replaced by a water soluble synthetic amphoteric polymer wherein upon imagewise exposure and development a sharper wash-off image is obtained.

SUMMARY OF THE INVENTION

In accordance with this invention there is provided a wash-off film for tanning development comprising at least one unhardened gelatin-containing layer of which at least one gelatin-containing layer is an unhardened silver halide emulsion with a gelatin binder, the improvement wherein 5 to 60% by weight of the gelatin in at least one of the gelatin-containing layers is replaced with a water soluble synthetic amphoteric polymer consisting essentially of at least one of each of three constituents: (a) carboxylic acid, (b) alkyl primary amine, and (c) secondary and/or tertiary amine, constituents (a), (b) and (c) being present in 10 to 60 mole percent, 1 to 20 mole percent, and 10 to 60 mole percent, respectively, based on the total moles of the amphoteric polymer whereby a sharper wash-off image is obtained by incorporation of the amphoteric polymer.

In accordance with another aspect of this invention there is provided a process for preparing a wash-off film for tanning development which comprises (a) preparing by emulsion polymerization in a reaction medium a prepolymer by reacting methyl acrylate and one or more acrylic monomers having secondary and/or tertiary amine functionality;
(b) hydrolyzing the methyl acrylate moiety of the prepolymer to acrylic acid groups:
(c) neutralizing the reaction medium;
(d) reacting the acrylic acid groups of the prepolymer with ethyleneimine or propyleneimine to form an amphoteric polymer with pendant alkyl primary amine groups:
(e) separating the amphoteric polymer from the reaction medium; and
(f) incorporating the amphoteric polymer into an unhardened gelatino-silver halide wash-off emulsion, the amphoteric polymer replacing 5 to 60% of the gelatin binder of the unhardened gelatino-silver halide emulsion.

In accordance with still another aspect of this invention, there is provided a process for preparing a wash-off film for tanning development which comprises (a) preparing a solution of at least one acrylic monomer having a primary amine functionality and at least one acrylic monomer having a secondary and/or tertiary amine functionality;
(b) adding acid to protonate the amine monomers;
(c) adding acrylic and/or methacrylic acid monomer;
(d) heating the solution of monomers in the presence of a polymerization initiator to react the monomers and cooling to ambient temperature whereby an amphoteric polymer is formed;

(e) neutralizing excess acid from the amphoteric polymer;

(f) separating the amphoteric polymer from the solution; and (g) incorporating the amphoteric polymer into an unhardened gelatino-silver halide wash-off emulsion, the amphoteric polymer replacing 5 to 60% of the gelatin binder of the unhardened gelatino-silver halide emulsion.

DETAILED DESCRIPTION OF THE INVENTION

The term "wash-off film" as used herein means a light sensitive silver halide photographic element having an unhardened gelatino-silver halide emulsion layer capable of tanning development wherein the tanning developer is present in either the silver halide emulsion layer or preferably is present in an auxiliary layer in a multiple layer light sensitive element. Alternatively, the developer can be present in a processing solution.

It has been discovered that sharper wash-off images can be produced when from 5 to 60% by weight, preferably 10 to 20% by weight of gelatin binder is replaced with a water soluble synthetic acrylic amphoteric polymer containing at least one each of three constituents: (a) carboxylic acid, (b) primary amine, and (c) secondary and/or tertiary amine. The amphoteric polymers have an isoelectric point of 4 to 8, preferably 5 to 7 and have a number average molecular weight in the range of 10,000 to 150,000. Number average molecular weights ($\overline{M}_n$) can be determined by gel permeation chromatography. While at least one constituent of types (a), (b) and (c) are required in an amphoteric polymer, the polymer can have more than one of (a), (b), or (c) present therein. Such polymers are preferably comprised of 10 to 60 mole percent of the carboxylic acid, 1 to 20 mole percent of the primary amine and 10 to 60 mole percent of the secondary and/or tertiary amine. Suitable amphoteric polymers, for example, include:

| Polymer | Molar Ratios |
|---|---|
| AA—DMAEMA—APA | (4-3-1) |
| AA—DMAEMA—MorphEMA—APA | (4-2-1-1) |
| AA—MAA—DMAEMA—DEAEMA—t-Butyl—AEMA—APA—APMA | (1.6-1.6-1-1-1-0.065-0.065) |
| AA—MAA—DMAEMA—PipEMA—APA—APMA | (2-2-2-1-0.047-0.047) |
| AA—MA—HEMA—DMAEMA—DEAEMA—MorphEMA—PipEMA—t-ButylAEMA—APA | (3.8-3.8-4-1-1-4-1-1-2.3) |
| AA—MAA—DMAEMA—DEAEMA—MorphEMA—PiPEMA—t-ButylAEMA—AEMA | (3-3-1-1-1-1-1-1) |
| | (1-1-1-1-1-1-1-1) |
| AA—MA—DMAEMA—APA | (4.4-2.5-2.8-1) |
| AA—MA—DMAEMA—MorphEMA—APA | (2.6-2-1-1-0.95) |

One or more constituents can be present in the amphoteric polymer as nonfunctional groups, e.g., methyl acrylate, ethyl methacrylate, hydroxyethyl methacrylate, etc. The term "consisting essentially of" does not preclude the presence of the nonfunctional groups as long as they do not affect the operability of the invention.

Throughout the specification, including the examples below, the letter designations for the constituents of the amphoteric polymers are as follows:

AA—acrylic acid
DMAEMA—dimethylaminoethyl methacrylate
APA—2-aminopropyl acrylate
MorphEMA—morpholinoethyl methacrylate
DEAEMA—diethylaminoethyl methacrylate
t-ButylAEMA—t-butylaminoethyl methacrylate
PipEMA—piperidinoethyl methacrylate
AEMA—aminoethyl methacrylate
HEMA—2-hydroxyethyl methacrylate
MA—methyl acrylate
MAA—methacrylic acid
APMA—2-aminopropyl methacrylate
AEA—aminoethyl acrylate By way of illustration a method for producing the first amphoteric polymer listed above is as follows:

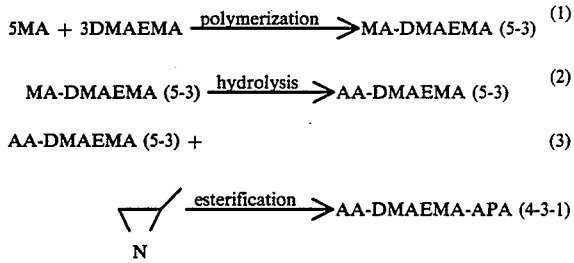

The acrylic prepolymers represented by reaction (1) above, may be made using a continuous-flow reactor or by a batch process. Two or more monomers may be used in the polymerization using initial or staged addition.

Preferably, the polymerization step is carried out by emulsion techniques because the reaction proceeds more rapidly in this manner than by solution techniques such as described in Procedure 2 below. Emulsion polymerization can be carried out by known procedures, preferably using potassium persulfate as the polymerization initiator. Polymerization temperature is preferably about 50° to 70° C. although with a redox initiator system, e.g. potassium persulfate/N,N-dimethylaminoethanol, temperatures as low as about 0° C. can be used. The polymerization can be accomplished by batch or continuous processes. An expanding batch process with specific, gradual, controlled addition of monomer, initiator and emulsifier solution, and a continuous overflow process are preferred. Such procedures are more fully described in the Examples below.

Useful monomers containing secondary or tertiary amine groups may be prepared by a transesterification reaction between methyl methacrylate and a secondary or tertiary amine compound which contains an alcohol functionality, such as that represented by reaction (4) below:

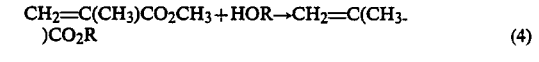

R represents that part of the compound containing the secondary or tertiary amine functionality. Examples of compounds represented by HOR are 2-dimethylaminoethanol, 2-diethylaminoethanol, 2-morpholinoethanol, t-butylaminoethanol, and 2-piperidinoethanol. Examples of monomers prepared from reaction (4) above are dimethylaminoethyl methacrylate, diethylaminoethyl methacrylate, morpholinoethyl methacrylate, t-butylaminoethyl methacrylate, and piperidinoethyl methacrylate.

Tertiary amine monomers may alternatively be prepared by reaction between isocyanatoethyl methacrylate and a tertiary amine compound which contains an alcohol functionality, such as that represented by reaction (5) below:

$$CH_2{=}C(CH_3)CO_2(CH_2)_2NCO + HOR \rightarrow CH_2{=}C(CH_3)CO_2(CH_2)_2NHCO_2R \quad (5)$$

R represents that part of the compound containing the tertiary amine functionality. Examples of compounds represented by HOR may be taken from the tertiary amine compounds listed above. Examples of monomers obtained from reaction (5) above are 2-((2-Dimethylaminoethyl)carbamamido)ethyl methacrylate, 2-((2-Diethylaminoethyl)carbamamido)ethyl methacrylate, 2-((2-Morpholinoethyl)carbamamido)ethyl methacrylate, and 2-((2-Piperidinoethyl)carbamamido)ethyl methacrylate.

During the hydrolysis step, represented by reaction (2) above, acrylate ester groups are rapidly converted to carboxylate salt groups in the presence of a base. The rate of base catalyzed hydrolysis of acrylate esters is orders of magnitude faster than for methacrylate esters. This can be shown by running side by side hydrolysis experiments with polymethyl-methacrylate and polymethylacrylate. Substantially quantitative conversion of the methylacrylate polymer to polyacrylic acid occurs while substantially no significant conversion of polymethylmethacrylate to methacrylic acid occurs, which can be confirmed for such polymers by solubility, elemental analysis and pH titration of the resultant hydrolysis product. Copolymers of MA, MMA and DMAEMA can also be prepared and hydrolyzed under conditions where: (1) excess base is added and (2) where less than a stoichiometric amount of base is added based on MA content in the prepolymer. In each case only the MA is significantly hydrolyzed and the degree of hydrolysis is stoichiometrically equal to the amount of base added.

Basic hydrolysis of the acrylic prepolymer is preferably carried out with aqueous potassium hydroxide, preferably in about a 10 to 20 percent solution of the base and preferably at a temperature of about 65° to 90° C. Neutralization of the hydrolyzed polymer can be accomplished with a strong acid, e.g., nitric acid, and the polymer can be separated from solution by isoelectric precipitation in excess water. The resulting amphoteric prepolymer can be redissolved, after purification, at a pH other than the isoelectric point. Alternatively, prepolymer neutralization can be accomplished with an acidic ion-exchange resin. Slightly less than the calculated amount of resin is usually employed to facilitate separation of the amphoteric prepolymer solution which can be used directly, if desired.

Pendant primary amine groups are inserted into the amphoteric polymer by reacting carboxylic acid groups derived from the above hydrolysis step with ethyleneimine or propyleneimine as represented by reaction (3) above. The ethyleneimine or propyleneimine is added in stoichiometrically limiting amounts to determine the levels of pendant primary amine groups and carboxylic acid groups in the final polymer. In the case of ethyleneimine, the aminoethyl structure is the predominant product while in the case of propyleneimine, the 2-aminopropyl structure is predominant. The reactions of propyleneimine and related compounds with carboxylic acids are described in: Djordjevic, Z. B., BRANCHED POLYMERS IN SOL-GEL TRANSITION, Ph. D. Thesis, Dept. of Physics, Massachusetts Institute of Technology, August 1984, pp. 36–39; Dermer, O. C. and Ham, G. B., ETHYLENEIMINE AND OTHER AZIRIDINES, Academic Press, New York (1969).

Although the method described by reaction (3) above for preparing the amphoteric polymer with pendant primary amines is preferred, a monomer containing a primary amine group may also be added into the copolymerization step described by reaction (1) above. The polymer can be purified by coagulation in acetone and redissolving in water. Ion exchange can be used for still further purification.

The polymer may also be made by solution polymerization in which a free acid monomer is incorporated directly into the polymer. To prevent Michael addition between the amine monomer or monomers (e.g., addition of the amine moiety to the double bond in the acrylic acid) during polymerization, acid is added in an amount necessary to completely protonate all amine present. Following polymerization in the presence of a polymerization initiator, e.g., potassium persulfate, or other known aqueous soluble polymerization initiator, the reaction mixture is neutralized with base. Preferably, the acid is a strong acid such as nitric acid, and the base is a strong base such as potassium hydroxide. The amount of strong base added is equal to the amount of strong acid originally added to block Michael addition. At no time are reaction conditions made favorable for hydrolysis of methylacrylate, if present, or any other ester in the reaction mixture. If the polymer was not made with a primary amine containing monomer, pendant primary amine groups are inserted into the polymer with the addition of ethyleneimine or propyleneimine, as described above.

The synthetic amphoteric polymers useful in the present invention are water soluble and are used as a cobinder with gelatin to produce wash-off films with improved image sharpness. Such gelatin and amphoteric polymer cobinders can be used in one or more layers of a wash-off film containing a silver halide emulsion, carbon black or other pigment and an incorporated developer. A preferred wash-off film contains in addition to an amphoteric acrylic polymer as part of the binder a stabilized carbon black dispersion. With such a film the advantage of the present invention is observed after tanning development and wash-off of the untanned areas of the film. With from 5 to 60% by weight, preferably 10 to 20% by weight, of the gelatin replaced by the polymer, a sharper image of higher resolution is observed in which the sidewalls of the wash-off image are more uniform than the more ragged sidewalls of control films containing only gelatin as the binder. It has been found that when other constituents are kept constant that better image sharpness is observed when the amphoteric polymer contains acrylic acid rather than methacrylic acid and APA instead of AEMA. Without limiting the invention it is postulated that the improvement is due to the nongelling characteristics of the polymers which could provide for cleaner breakage of the cobinder combination than would be possible with gelatin alone, and that the primary amine groups of the amphoteric polymer provide increased crosslinking in the tanned areas. A preferred embodiment is described in Example 1.

EXAMPLES

The following are illustrative procedures and examples of the invention in which all parts and percentages are by weight and all degrees are Celsius unless otherwise noted.

Polymer isoelectric points (pI) were determined by titration of a dilute polymer solution from the acidic and basic sides of the pI until cloudiness was observed. The pI was taken as the halfway point between the two cloud points. At the isoelectric point, the polymers are least water soluble and precipitation of the polymers occurs.

All reactors and reservoirs were flushed with nitrogen, and solutions were maintained under a nitrogen atmosphere.

In the procedures and examples set out below, pH titration curves were determined for the products. Molar composition and component identification were made by measuring endpoint inflection points and plateau region midpoints corresponding to pKa's of the acid and base components. The results were compared with curves obtained for each independent monomer used in the preparation. The compositions of similar and identical polymers prepared earlier were confirmed by a combination of methods, including gel permeation chromatography, elemental analysis and infrared spectroscopy.

PROCEDURE 1

Preparation of AA-DMAEMA-APA (4-3-1) by Emulsion Polymerization

Apparatus:

A jacketed resin kettle reactor was fitted with a nitrogen inlet, thermometer, and thermocouple probe to record the thermal profile of the reaction and a vibromixer stirrer.

An emulsifier solution was prepared with 500 ml water, 5 g Triton® QS-30 surfactant, and 0.5 g $K_2S_2O_8$. The solution pH was adjusted to 7 and the solution was placed in the reactor and heated to 60° C. in a constant temperature bath. Methyl acrylate and dimethylaminoethyl methacrylate monomers were slowly added over a period of one hour to the reaction mixture from an addition funnel during the reaction cycle. The prepolymer so formed was coagulated with acetone, washed and dissolved overnight in ethanol to produce a cloudy solution.

The prepolymer was hydrolyzed with KOH and then acidified to pH 5.5 with nitric acid.

The final product was prepared by reacting with propyleneimine. The polymer showed a pI~4.0 by precipitation but remained cloudy throughout the entire pH range.

PROCEDURE 2

Preparation of AA-MA-HEMA-MorphEMA-APA (2.55-2-1-1-0.95) by solution polymerization A jacketed resin kettle was fitted with a stirrer, nitrogen bubbler, condenser and addition funnel. Kettle temperature was regulated by circulating water from a constant temperature water bath through the kettle jacket. To the kettle was added: 200 milliliters of ethanol and 3.6 milliliters of nitric acid, 10.0 grams acrylic acid, 6.85 g methyl acrylate, 5.18 g 2-hydroxyethyl methacrylate, 7.93 g morpholinoethyl methacrylate, and 0.5 ml mercaptoethanol (as chain transfer agent). After heating the reaction mixture to 65 degrees with stirring, a 50 milliliter aqueous solution containing 2.5 grams of potassium persulfate was added dropwise over a one hour period. The reaction mixture was stirred and heated for about four hours, then allowed to cool to room temperature. To the cooled reaction mixture was added, in order, 4.84 grams potassium hydroxide and 2.52 milliliters propyleneimine. The reaction mixture was heated to 60 degrees for 2 hours, then cooled. The polymeric product was isolated from the reaction mixture by coagulating in acetone. The coagulated polymer solution was dissolved in water and purified further by passing through a mixed-bed ion exchange resin.

PROCEDURE 3

Preparation of AA-DMAEMA-MorphEMA-APA (4-2-1-1) with continuous overflow reactor A 3-liter jacketted reaction kettle was fitted with an overflow tube and heated with water circulated from a 4-liter kettle thermostatically controlled at 55°-60° C. The reaction kettle was also equipped with a stirrer and stainless steel nitrogen, emulsifier, monomer and initiator feed lines. Stock solutions and associated pump rates were:

Emulsifier:
- 3000 ml water
- 30 g Triton(R) QS-30 surfactant
- 30 ml Dimethylaminoethanol
- Pump Rate: 62.5 ml/min.

Initiator:
- 1250 ml water
- 25 g Potassium Persulfate
- Pump Rate: 10.0 ml/min.

Monomer Feed:
- 904 ml MA
- 680 ml DMAEMA
- 417 ml MorphEMA
- Pump Rate: 26.8 ml/min.

Monomer Precharge:
- 25.2 ml MA
- 11.3 ml DMAEMA
- 2.3 ml MorphEMA

To start the synthesis, 2500 ml emulsifier solution was heated, with stirring, in the reactor kettle to 55°-60° C. After the temperature stabilized, the emulsifier and initiator feeds were started and allowed to run for ten minutes. The monomer precharge was then injected with a syringe and the monomer feed started.

The reactant solution flowing out of the reaction kettle was coagulated in a 4-liter bucket containing ice. The polymer was separated from the emulsifier/monomer solution by decanting and washed several times with water. The polymer portion collected while the system equilibrated during the first 20 minutes was discarded. Further portions were collected and washed at 20–30 minute intervals, then combined. Feed solutions were replenished as needed throughout the run to provide a theoretical polymer yield of 13 kg. The swollen, coagulated polymer was dissolved in ethanol to make roughly a 20% solution. The solids content and solution density were determined before proceeding to the hydrolysis and amination steps.

In the hydrolysis step, 2500 ml polymer solution of known solids content and density was heated, with stirring, in a 4-liter kettle to 60° C. Enough 50% KOH solution was added slowly with a dropping funnel to theoretically hydrolyze all methyl acrylate to acrylic acid. After addition, the solution was heated to 80° C. for 1 hour, then cooled with ice water. When the temperature of the polymer solution had dropped below 35° C., the solution was adjusted to pH 5 with concentrated nitric acid for the amination reaction.

Enough propyleneimine to theoretically react with one equivalent of the pendant acid groups was added slowly with a dropping funnel over a 1 hour period, then heated to 60° C. for 1 hour. The heating period, besides driving the reaction between the polymeric pendant acid groups and the propyleneimine, also acted to hydrolyze excess propyleneimine. The solution was allowed to cool overnight and then filtered to remove precipitated salts. The polymer was finally coagulated in acetone (ethanol could also be used).

PROCEDURE 4

Using both batch and continuous reaction methods a variety of acrylic amphoteric polymers were prepared. Table 1 below details the polymeric compositions prepared and measured pI values of some of the amphoteric polymers. Ethyleneimine could be substituted equally for propyleneimine as desired.

TABLE 1

| Amphoteric Polymer Compositions | Polymer Ratios | pI |
|---|---|---|
| AA—DMAEMA—APA | (4-3-1) | 7.6 |
| AA—DMAEMA—MorphEMA—APA | (4-2-1-1) | 5.0 |
| AA—MAA—DMAEMA—DEAEMA—t-Butyl—AEMA—APA—APMA | (1.6-1.6-1-1-1-0.065-0.065) | 6.8 |
| AA—MAA—DMAEMA—PipEMA—APA—APMA | (2-2-2-1-0.047-0.047) | 6.2 |
| AA—MA—HEMA—DMAEMA—DEAEMA—MorphEMA—PipEMA—t-ButylAEMA—APA | (3.8-3.8-4-1-1-4-1-1-2.3) | 7.5 |
| AA—MAA—DMAEMA—DEAEMA—MorphEMA—PipEMA—t-ButylAEMA—AEMA | (3-3-1-1-1-1-1-1) | — |
| AA—MA—DMAEMA—APA | (1-1-1-1-1-1-1-1) | — |
| AA—MA—DMAEMA—MorphEMA—APA | (4.4-2.5-2.8-1) | — |
| | (2.6-2-1-1-0.95) | — |

PROCEDURE 5

Transesterification Synthesis Of Morpholinoethyl Methacrylate

A 1000 ml resin kettle was equipped with a still head, air bubbler, and thermometer. The kettle was placed in a regulated water bath, set at 80°. 750 ml methyl methacrylate was added to the kettle followed by a solution containing 250 g morpholinoethanol, 5.0 g sodium methoxide and 0.5 g p-methoxyphenol. During the 120 minute reaction time, air was bubbled slowly through the vigorously stirred solution. After 30 and 60 minutes, 5.0 g sodium methoxide was added. At the end of the reaction time, the mixture was cooled and neutralized with 17.0 g glacial acetic acid.

The contents of the reactor were transferred to a 2-liter separatory funnel. The solution was extracted once with a liter of 9.5% sulfuric acid, then again with 0.5 liter of 3% sulfuric acid. The aqueous extracts were combined and extracted with petroleum ether to remove residual methyl methacrylate. The aqueous solution was made basic with 500 ml of 30% KOH and extracted twice with petroleum ether. The petroleum ether solutions, containing product, were dried over magnesium sulfate then stripped with a rotovac. The product was checked for purity by NMR.

PROCEDURE 6

Transesterification Synthesis Of Piperidinoethyl Methacrylate

A 1 liter resin kettle was fitted with an air bubbler, temperature probe and still head. To the kettle was added, in order: 233 grams piperidinoethanol, 5.0 grams sodium methoxide, 0.5 grams p-methoxy phenol (to inhibit polymerization), and 750 milliliters methyl methacrylate. With a slow stream of air bubbling through the reaction mixture, the mixture was stirred vigorously and heated to 80 degrees with a constant temperature water bath. 5.0 grams sodium methoxide were added 30 and 60 minutes after the start of the reaction. After 120 minutes, the reaction mixture was cooled and neutralized with 17.0 grams acetic acid. The reaction mixture was transferred to a separatory funnel. The product was extracted from the reaction mixture into one liter of aqueous solution containing 95 grams concentrated sulfuric acid. The reaction mixture was treated with 500 milliliters of aqueous solution containing 15 grams concentrated sulfuric acid to extract remaining product. The two aqueous portions were combined and extracted with petroleum ether (boiling point 30–60 degrees) to remove residual methyl methacrylate, then rendered basic with 500 milliliters of aqueous solution containing 150 grams potassium hydroxide. The product was extracted from the aqueous solution with petroleum ether. The petroleum ether solution was dried over anhydrous magnesium sulfate. The petroleum ether was removed from the product with a rotary film evaporator under reduced pressure.

EXAMPLE 1

A silver iodobromide wash-off film (control) was prepared with:

6.2 g AgBr/square meter
0.19 g carbon black(1)/square meter
0.38 g developer(2)/square meter
1.9 g gelatin/square meter (1) stabilized as described in Example 3 of U.S. Pat. No. 4,233,392.
(2) 3,3,3',3'-tetramethyl-5,6,5',6'-tetrahydroxyspiro-bis-indane as described in U.S. Pat. No. 3,440,049.

A second wash-off film was prepared as above except that 17% of the gelatin binder was replaced with a synthetic amphoteric polymer comprising: AA-DMAEMA-MorphEMA-APA (4-2-1-1) prepared as described in Procedure 3.

The control and film of the invention were exposed through a resolution target. Incorporated developer was activated with a potassium hydroxide/-carbonate solution to initiate tanning development. Wash-off images of the resolution target were produced by spraying with warm water. Higher resolution was observed for the present invention compared to the gelatin binder control. A microscopic examination of the sidewalls of the images revealed that the incorporation of the synthetic amphoteric polymer produced quite even and regular sidewalls compared to the ragged appearance of the control.

EXAMPLE 2

A control wash-off film was prepared with the following composition:

1.3 g AgCl/square meter
0.6 g Hydroquinone/square meter
0.09 g Garbon black/square meter
2.0 g Gelatin binder/square meter Wash-off films of the invention were prepared in which 5, 10, 20, 30, 40, 50 and 60% of the gelatin binder was replaced by the amphoteric polymer prepared as described in Procedure 3. Upon examination of samples after exposure, tanning development and warm water wash-off, better line edge sharpness was observed in all cases for the amphoteric polymer containing films. Preferred performance was observed for the films in which 10 and 20% of the gelatin was replaced by the synthetic amphoteric polymer.

EXAMPLE 3

A control film was prepared as in Example 2 except the carbon black was omitted. A wash-off film of the invention was prepared which contained 30% of the gelatin replaced by amphoteric polymer. After wash-off development, line edge sharpness was improved for the film prepared according to this invention in comparison to the gelatin binder control. This shows that the improved edge sharpness is not connected solely with carbon black being incorporated in one or more layers of the wash-off film.

EXAMPLE 4

Two-layer silver iodobromide wash-off films were made with the following compositions:

| Bottom Layer | Top Layer |
|---|---|
| 0.51 g Carbon black/sq. m. | 4.9 g AgBr/sq. m. |
| 0.36 g Total binder/sq. m. | 0.30 g Hydroquinone/sq. m. |
| | 1.54 g Total binder/sq. m. |

One film contained only gelatin as the binder in both layers (control). A second film replaced 10% of the gelatin with AA-DMAEMA-MorphEMA-APA polymer prepared as described in Procedure 3 in the bottom layer. A third film replaced 10% of the gelatin with the same polymer in the top layer, and a fourth film replaced 10% of the gelatin in both layers. Rating the film for edge sharpness after wash-off, film four was best, film three next best and the film two was just slightly improved over the control.

EXAMPLE 5

Improved edge sharpness was observed in wash-off films containing from 5 to 30% of the gelatin binder replaced by one of the following synthetic amphoteric polymers:

| Polymer | Molar Ratio |
|---|---|
| AA—DMAEMA—APA | (4-3-1) |
| AA—DMAEMA—MorphEMA—APA | (4-2-1-1) |
| AA—MAA—DMAEMA—DEAEMA—t-Butyl—AEMA—APA—APMA | (1.6-1.6-1-1-1-0.065-0.065) |
| AA—MAA—DMAEMA—PipEMA—APA—APMA | (2-2-2-1-0.047-0.047) |
| AA—MA—HEMA—DMAEMA—DEAEMA—MorphEMA—PipEMA—t-ButylAEMA—APA | (3.8-3.8-4-1-1-4-1-1-2.3) |
| AA—MAA—DMAEMA—DEAEMA—MorphEMA—PipEMA—t-ButylAEMA—AEMA | (3-3-1-1-1-1-1-1) |
| | (1-1-1-1-1-1-1-1) |
| AA—MA—DMAEMA—APA | (4.4-2.5-2.8-1) |
| AA—MA—DMAEMA—MorphEMA—APA | (2.6-2-1-1-0.95) |

EXAMPLE 6

A wash-off drafting film was prepared as taught in U.S. Pat. No. 3,353,958 and a wash-off film of the invention was prepared in which 10% of the gelatin in the silver chloride emulsion was replaced with the amphoteric polymer described in Procedure 3. Improved image sharpness was observed by microscopic examination.

EXAMPLE 7

A control wash-off film was made with tubular silver bromide crystals of 0.16 cubic micron average volume, 0.13 micron average thickness and 9.7 average aspect ratio. The film composition was:

5.2 g AgBr/square meter
0.25 g Hydroquinone/square meter
2.0 g Gelatin binder/square meter A wash-off film of the invention was prepared in which 19 percent of the gelatin binder was replaced with the amphoteric polymer described in Procedure 3. After wash-off processing, line edge sharpness was improved for the film prepared according to this invention in comparison to the control containing only gelatin binder.

What is claimed is:

1. A wash-off film for tanning development comprising at least one unhardened gelatin-containing layer of which at least one gelatin-containing layer is an unhardened silver halide emulsion with a gelatin binder, the improvement wherein 5 to 60% by weight of the gelatin in at least one of the gelatin-containing layers is replaced with a water soluble synthetic acrylic amphoteric addition polymer consisting essentially of at least one of each of three constituents: (a) carboxylic acid selected from the group consisting of acrylic acid and methacrylic acid, (b) acrylic alkyl primary amine, and (c) acrylic secondary and/or tertiary amine, constituents (a), (b) and (c) being present in 10 to 60 mole percent, 1 to 20 mole percent, and 10 to 60 mole percent, respectively, based on the total moles of the amphoteric polymer whereby a sharper wash-off image is obtained by incorporation of the amphoteric polymer.

2. A wash-off film according to claim 1 wherein 10 to 20% by weight of gelatin is replaced by synthetic acrylic amphoteric polymer.

3. A wash-off film according to claim 1 wherein a tanning developer is present in at least one of the gelatin-containing layers.

4. A wash-off film according to claim 1 wherein stabilized carbon black is present in at least one of the gelatin-containing layers.

5. A wash-off film according to claim 1 wherein the acrylic amphoteric polymer has an isoelectric point of 4 to 8.

6. A wash-off film according to claim 1 wherein the acrylic amphoteric polymer contains aminopropylacrylate.

7. A wash-off film according to claim 1 wherein component (b) is an alkyl primary amine taken from the group consisting of 2-aminopropyl acrylate, 2-aminopropyl methacrylate, aminoethyl acrylate and aminoethyl methacrylate.

8. A wash-off film according to claim 1 wherein component (c) is a secondary and/or tertiary amine taken from the group consisting of dimethylaminoethyl methacrylate, morpholinoethyl methacrylate, diethylaminoethyl methacrylate, t-butylaminoethyl methacrylate, and piperidinoethyl methacrylate.

9. A process for preparing a wash-off film for tanning development which comprises (a) preparing by emulsion polymerization in a reaction medium a prepolymer by reacting methyl acrylate and one or more acrylic monomers having secondary and/or tertiary amine functionality:
(b) hydrolyzing the methyl acrylate moiety of the prepolymer to acrylic acid groups;
(c) neutralizing the reaction medium;
(d) reacting acrylic acid groups of the prepolymer with ethyleneimine or propyleneimine to form an amphoteric polymer with pendant alkyl primary amine groups;
(e) separating the acrylic amphoteric polymer from the reaction medium:
(f) incorporating the acrylic amphoteric polymer into an unhardened gelatino-silver halide wash-off emulsion, the acrylic amphoteric polymer replacing 5 to 60% of the gelatin binder of the unhardened gelatino-silver halide emulsion.

10. A process according to claim 9 wherein in step (a) the prepolymer is prepared with at least one of the following monomers: dimethylaminoethyl-methacryalte, diethylaminoethyl methacrylate, morpholinoethyl methacrylate, piperidinoethyl methacrylate and t-butylaminoethyl methacrylate.

11. A process according to claim 10 wherein the hydrolyzing step (b) is carried out with potassium hydroxide.

12. A process according to claim 11 wherein the neutralizing step (c) is carried out with nitric acid.

13. A process according to claim 12 wherein the reacting step (d) is carried out at a temperature of at least 60° C.

14. A process according to claim 13 wherein acetone or ethanol is used in the separating step (e).

15. A wash-off film prepared according to the process of claim 9 wherein the gelatino-silver halide emulsion in addition to the acrylic amphoteric polymer contains stabilized carbon black and a tanning developer.

16. A process according to claim 9 wherein the secondary or tertiary amine monomers are prepared by transesterification of methyl methacrylate and a secondary or tertiary amine compound.

17. A process according to claim 9 wherein the tertiary amine monomers are prepared by reaction between isocyanatoethyl methacrylate and a tertiary amine compound with an alcoholic functionality.

18. A process according to claim 9 wherein the secondary and/or tertiary amine monomers are taken from the group consisting of dimethylaminoethyl methacrylate, diethylaminoethyl methacrylate, morpholinoethyl methacrylate, t-butylaminoethyl methacrylate, piperidinoethyl methacrylate, 2-((2-dimethylaminoethyl) carbamamido)ethyl methacrylate, 2-((diethylaminoethyl) carbamamido)ethyl methacrylate. 2-((2-morpholinoethyl) carbamamido)ethyl methacrylate, and 2-((2-piperidinoethyl)carbamamido)-ethyl methacrylate.

19. A process for preparing a wash-off film for tanning development which comprises (a) preparing a solution of at least one acrylic monomer having a primary amine functionality and at least one acrylic monomer having a secondary and/or tertiary amine functionality;
(b) adding acid to protonate the amine monomers;
(c) adding acrylic and/or methacrylic acid monomer;
(d) heating the solution of monomers in the presence of a polymerization initiator to react the monomers and cooling to ambient temperature whereby an acrylic amphoteric polymer is formed;
(e) neutralizing excess acid from the acrylic amphoteric polymer;
(f) separating the acrylic amphoteric polymer from the solution; and
(g) incorporating the acrylic amphoteric polymer into an unhardened gelatino-silver halide wash-off emulsion, the acrylic amphoteric polymer replacing 5 to 60% of the gelatin binder of the unhardened gelatino-silver halide emulsion.

20. A process according to claim 19 wherein in step (a) the acrylic monomer present has solely secondary and/or tertiary amine functionality and after step (e) the acid group of the amphoteric polymers are reacted with ethyleneimine or propyleneimine to form an acrylic amphoteric polymer with pendant alkyl primary amine groups.

21. A process according to claim 19 wherein the acrylic monomer having amine functionality is placed in a water-alcohol solution.

22. A process according to claim 19 wherein the polymerization initiator is potassium persulfate.

23. A process according to claim 19 wherein the acid used in step (b) is nitric acid.

24. A process according to claim 23 wherein potassium hydroxide is used to neutralize excess acid in step (e).

25. A process according to claim 19 wherein the acrylic monomer having secondary and/or tertiary amine functionality is taken from the group consisting of dimethylaminoethyl methacrylate, morpholinoethyl methacrylate, diethylaminoethyl methacrylate, t-butylaminoethyl methacrylate, piperidinoethyl methacrylate, and mixtures thereof.

26. A process according to claim 25 wherein the acrylic monomer having primary amine functionality is taken from the group consisting of aminoethyl methacrylate, aminoethyl acrylate, 2-aminopropylacrylate and 2-aminopropylmethacrylate.

* * * * *